US005602627A

United States Patent [19]

Kurokawa

[11] Patent Number: 5,602,627

[45] Date of Patent: Feb. 11, 1997

[54] ELECTRIFYING ROLLER, ROLLER ELECTRIFYING APPARATUS USING THE SAME, AND IMAGE FORMING APPARATUS USING THE SAME

[75] Inventor: Junji Kurokawa, Yokohama, Japan

[73] Assignee: Ricoh Company, Ltd., Tokyo, Japan

[21] Appl. No.: 539,214

[22] Filed: Oct. 4, 1995

[30] Foreign Application Priority Data

| | | | |
|---|---|---|---|
| Oct. 5, 1994 | [JP] | Japan | 6-241630 |
| Nov. 30, 1994 | [JP] | Japan | 6-297008 |
| Dec. 13, 1994 | [JP] | Japan | 6-309281 |
| Sep. 25, 1995 | [JP] | Japan | 7-245929 |

[51] Int. Cl.[6] ..... G03G 15/02

[52] U.S. Cl. ..... 399/176; 361/225; 361/230

[58] Field of Search ..... 355/219; 430/902; 361/225, 230, 235

[56] References Cited

U.S. PATENT DOCUMENTS

| | | | |
|---|---|---|---|
| 5,253,022 | 10/1993 | Takeuchi et al. | 355/274 |
| 5,272,505 | 12/1993 | Shishido et al. | 355/219 |
| 5,287,146 | 2/1994 | Uno et al. | 355/219 |
| 5,321,471 | 6/1994 | Ito et al. | 355/219 |
| 5,497,219 | 3/1996 | Kurokawa et al. | 355/219 |

FOREIGN PATENT DOCUMENTS

| | | | |
|---|---|---|---|
| 0534437 | 3/1993 | European Pat. Off. | 355/219 |
| 0579499 | 1/1994 | European Pat. Off. | 355/219 |
| 63-149668 | 6/1988 | Japan . | |
| 1-142569 | 6/1989 | Japan | 355/219 |
| 1-210973 | 8/1989 | Japan | 355/219 |
| 2-198468 | 8/1990 | Japan . | |
| 3-123377 | 5/1991 | Japan . | |
| 3-196067 | 8/1991 | Japan . | |
| 4-138477 | 5/1992 | Japan | 355/219 |
| 4-333853 | 11/1992 | Japan . | |
| 4-347874 | 12/1992 | Japan | 355/219 |
| 5-16033 | 3/1993 | Japan . | |
| 5-80637 | 4/1993 | Japan . | |
| 5-307315 | 11/1993 | Japan | 355/219 |
| 6-003928 | 1/1994 | Japan | 355/219 |
| 6-35292 | 2/1994 | Japan | 355/219 |

*Primary Examiner*—Matthew S. Smith
*Attorney, Agent, or Firm*—Lowe, Price, LeBlanc & Becker

[57] ABSTRACT

There is provided by the present invention an electrifying roller having a roller layer having at least two layers of an elastic layer provided on a peripheral surface of core metal and a surface layer covering the elastic layer, wherein a slope ($\Delta I/\Delta V$) of the V-I characteristics of the roller layer is 1 or less, the electrifying roller is rotated in contact with the light-sensing drum, a voltage is loaded from a power supply unit to the core metal of the electrifying roller, and a surface of the light-sensing drum is electrified to a surface potential (Vs).

14 Claims, 4 Drawing Sheets

ELECTRIFYING ROLLER, ROLLER ELECTRIFYING APPARATUS USING THE SAME, AND IMAGE FORMING APPARATUS USING THE SAME

FIELD OF THE INVENTION

The present invention relates an electrifying roller used in an electrophotographic apparatus, a roller electrifying apparatus using the same, and an image forming apparatus using the same, and more particularly to an electrifying roller used for primary electrification and transfer electrification in an electrophotographic apparatus, a roller electrifying apparatus using the same, and an image forming apparatus using the same.

BACKGROUND OF THE INVENTION

Conventionally a method in which a high voltage (DC 6 to 8 KV) is loaded to a metal wire and electrification is executed by making use of generated corona has widely been used as an electrifying process in an electrophotographic process. In the corona discharge system as described above, however, corona products such as ozone or nitrogen oxide generated when corona is generated denature a surface of a light-sensing body, and promote shading or degradation of an image, and contamination of wire gives bad effects to a quality of an image.

On the other hand, there has been developed and put into practical use a contact electrifying system in which a voltage is loaded to an electrifying member in contact with a light-sensing drum for electrifying a surface of the light-sensing body. This electrifying system has the advantage that a voltage drop in the power supply unit and a quantity of generated ozone are relatively small, but the uniformity in electrification is substantially inferior to that in the corona discharge system.

To improve the uniformity in electrification, for instance, in Japanese Patent Laid-Open Publication No. 149668/1988 disclosing the "contact electrifying method", it is disclosed that the uniformity in electrification can substantially be improved by superimposing an AC voltage having an inter-peak voltage which is 2 times or more larger than that of an electrification start voltage (V th) when a DC voltage is loaded.

Also for improving the uniformity in electrification, for instance in Japanese Patent Publication No. 16033/1993 disclosing an "electrifying apparatus", it is disclosed that uniformity in electrification can substantially be improved with the electrifying apparatus comprising a conductive base to which a voltage is loaded, a first resistive layer provided at a position closer to an electrified body than this conductive base, and a second resistive layer provided at a position closer to said electrified body than this first resistive layer and having a larger volume resistivity than that of the first resistive layer, and having an area where a distance from said electrified body becomes larger and by loading a voltage having an inter-peak voltage which is 2 times or more larger than an electrification start voltage to the electrified body.

However, in the contact electrification method disclosed in Japanese Patent Laid-Open Publication No. 149668/1991, to superimpose a high AC voltage having an inter-peak voltage which is 2 times or more larger than an electrification start voltage (V th) when a DC voltage is loaded, an AC power supply source different from that for a DC power is required, which causes increase of the apparatus cost. Furthermore by consuming a quantity of AC power, there occur various problems such as generation of a large quantity of ozone or drop in durability of the electrifying roller or the light-sensing body.

Although these problems can be solved by loading only a DC voltage to the electrifying roller, but when only a DC voltage is loaded to an electrifying roller, problems as described below occur.

(1) At first, an electrifying roller was prepared, according to the method disclosed in Japanese Patent Publication No. 16033/1993, by covering a metal core rod having a diameter of 8 mm with urethane rubber as an elastic layer containing carbon dispersed therein and having an electric resistance of $10^4$ Ωcm and thickness of 4 mm, and then providing a surface layer having a thickness of 25 mm made from a cellophane sheet with a volumic resistivity of $10^9$ Ωcm, and only a DC voltage was loaded, when nonuniformity in electrification was generated. Nonuniformity was generated when carbon black was dispersed in synthetic rubber as a material for an elastic layer of the electrifying roller. Namely nonuniformity in the electrifying roller in this case is generated because of electric nonuniformity in the elastic layer due to carbon black dispersement fault in synthetic rubber.

(2) A DC voltage of 1.5 KV with negative polarity was loaded to this electrifying roller to electrify a light-sensing drum such as an OPC to (–) 800 V, and the electrified light-sensing drum was used. In this case an excessive current flew through pin holes in the light-sensing layer, and a voltage loaded to the electrifying roller dropped, which made it impossible to electrify the light-sensing drum.

(3) An electrifying roller comprising EPRM with carbon dispersed therein as an elastic layer having an electric resistance in a range from $10^4$ to $10^5$ Ωcm and a thickness of 3 mm, hydrin rubber as a resistive layer having an electric resistance in a range from $10^7$ to $10^9$ Ωcm and a thickness of 100 μm, and carbon-dispersed nylon resin having an electric resistance in a range from $10^7$ to $10^9$ Ωcm and a thickness of 100 μm was used, and only a DC voltage was loaded, and in this case, because dispersibility of carbon and EPDM was good, electric uniformity of the elastic layer is improved, but withstand voltage capability of the roller layer is rather poor, so that leak of electric charge through pin holes in the light-sensing layer often occurred.

(4) In the conventional type of elastic layer made of carbon and synthetic rubber, it is possible to adjust an apparent electric resistance by changing a quantity of added carbon, but it is difficult to simultaneously realize appropriate conductivity.

(5) Furthermore, electric uniformity of an elastic layer can be improved by increasing a quantity of carbon dispersed therein to lower an electric resistance of the entire layer (to $10^4$ Ωcm), but when used only with a DC voltage, the withstand voltage capability becomes lower.

SUMMARY OF THE INVENTION

The present invention was made to solve the problems as described above, and it is an object of the present invention to make it possible to improve the withstand voltage capability of an electrifying roller even when electrification is performed by loading only a DC voltage and also to suppress leak of electric charge through pin holes in a light-sensing drum.

In an electrifying roller having a roller layer comprising at least two layers of an elastic layer provided around a peripheral surface of core metal and a surface layer covering a surface of the elastic layer, if (an electric layer of the elastic layer is in a range from $10^7$ to $10^9$ Ωcm, and at the same time) a slope (ΔI/ΔV) of the V-I characteristics of the roller layer when expressed on logarithmic paper is 1 or less, namely assuming that current values to given loaded voltages $V_1$, $V_2$ ($0<V_1<V_2<2$ KV) are $I_1$, $I_2$, by adjusting a value of $(\log I_2-\log I_1)/(\log V_2-\log V_1)$ so that the value will not surpass 1, the withstand voltage capability of the electrifying roller is improved, and the possibility of charge leak is eliminated.

Furthermore by adjusting an electric resistance of the elastic layer to a range from $10^7$ to $10^9$ Ωcm, the withstand voltage capability of the electrifying roller is improved, and the possibility of charge leak is eliminated. And also by loading a DC constant voltage of 1.6 KV or more with positive or negative polarity to the core metal, the light-sensing drum can be electrified to high electric potential.

Furthermore by adjusting a slope (ΔI/ΔV) of the V-I characteristics of a roller layer in an electrifying roller when expressed with logarithmic paper to 1 or below, a light-sensing drum can be electrified to high electric potential.

Because (at least an elastic layer of the electrifying roller has an electric resistance in a range from $10^7$ to $10^9$ Ωcm, and at the same time) a slope (ΔI/ΔV) of the V-I characteristics of the roller layer of the electrifying roller when expressed with logarithmic paper is 1 or less, the withstand voltage capability of the electrifying roller is improved, and the possibility of charge leak is eliminated. Also a voltage loaded to the core metal is a DC constant voltage of 1.6 KV or more with positive or negative polarity, so that the light-sensing drum can be electrified to high electric potential.

Furthermore by electrifying surface potential of the light-sensing drum to 850 V or more with positive or negative polarity, allowance is generated in the bias potential for development.

Furthermore the electrifying roller has a roller layer comprising two layers of an elastic layer (with an electric resistance in a range from $10^7$ to $10^9$ Ωcm) and a surface layer covering a surface of the elastic layer, and the V-I characteristics of the roller layer satisfies the following expression:

$$(\log I_2-\log I_1)/(\log V_2-\log V_1)\leqq 1.2$$

assuming that a current value when a DC voltage $V_1$ is 10 V is $I_1$ μA and a current value when a DC voltage $V_2$ is 100 V is $I_2$ μA.

Furthermore image forming is executed with an electrifying roller having a roller layer comprising two layers of an elastic layer (with an electric resistance in a range from $10^7$ to $10^9$ Ωcm) and a surface layer covering a surface of the elastic layer in which the V-I characteristics of the roller layer satisfies the following expression:

$$(\log I_2-\log I_1)/(\log V_2-\log V_1)\leqq 1.2$$

assuming that a current value when a DC voltage $V_1$ is 10 V is $I_1$ μA and a current value when a DC voltage $V_2$ is 100 V is $I_2$ μA.

Also by using an electrifying roller having a roller layer comprising two layers of an elastic layer (with an electric resistance in a range from $10^7$ to $10^9$ Ωcm) and a surface layer covering a surface of the elastic layer in which the V-I characteristics of the roller layer satisfies the following expression:

$$(\log I_2-\log I_1)/(\log V_2-\log V_1)\leqq 1.2$$

assuming that a current value when a DC voltage $V_1$ is 10 V is $I_1$ μA and a current value when a DC voltage $V_2$ is 100 V is $I_2$ μA, and also using an organic light-sensing body with the dielectric thickness ($D=d/\epsilon$) of 7.5 or more, image forming is executed by electrifying surface potential of the light-sensing body to 850 V or more with negative polarity.

Other objects and features of this invention will become understood from the following description with reference to the accompanying drawings.

DESCRIPTION OF THE PREFERRED EMBODIMENTS

Detailed description is made hereinafter for an electrifying roller, a roller electrifying apparatus using the same, and an image forming apparatus using the same according to the present invention with reference to the related drawings each in the order of [Embodiment 1], [Embodiment 2], [Embodiment 3], [Embodiment 4], [Embodiment 5], and [Embodiment 6].

[Embodiment 1]

Figure 1:
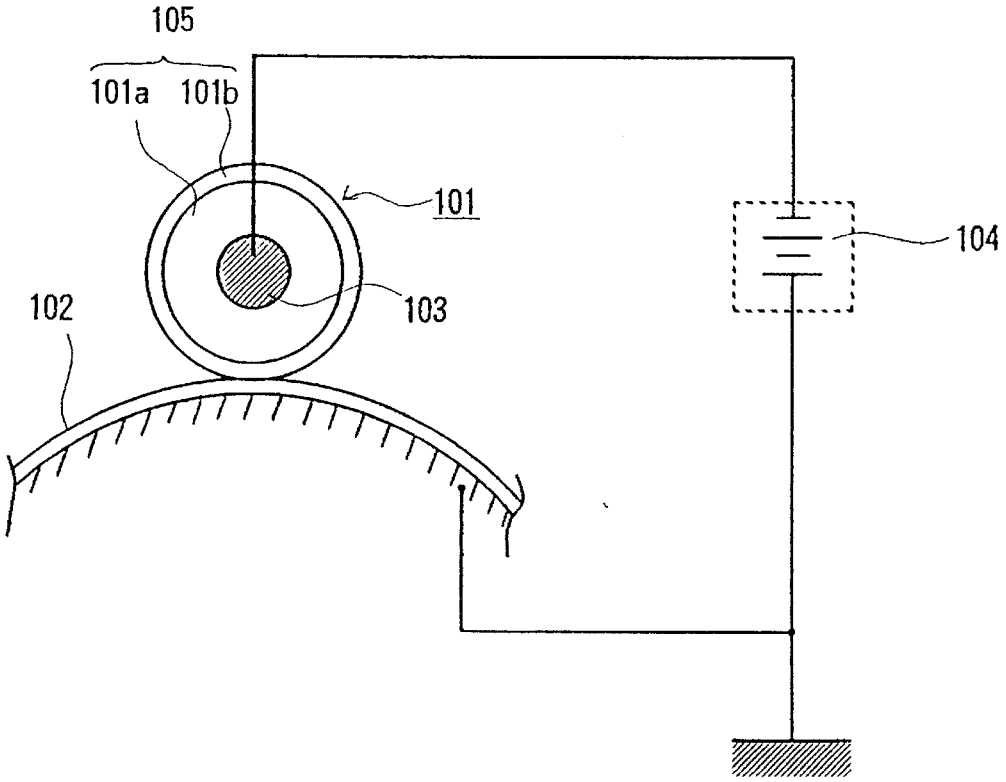
FIG. 1 is an explanatory view showing general configuration of an electrifying roller and a roller electrifying apparatus using the same.

Description is made for configuration of an electrifying roller and a roller electrifying apparatus using the same according to Embodiment 1 with reference to FIG. 1. An electrifying roller 101 has a roller layer 105 provided on a peripheral surface of core metal 103 and comprising two layers of an elastic layer 101*a* and a surface layer 101*b* covering a surface of the elastic layer 101*a*, and in the electrifying apparatus using the electrifying roller 101, the electrifying roller 101 is rotated in contact with a light-sensing drum 102, a voltage is loaded (a load voltage (Va) is injected) from a power supply unit 104 to core metal 103 of the electrifying roller 101, and a surface potential (Vs) is generated on a surface of the light-sensing drum 102.

Figure 2:
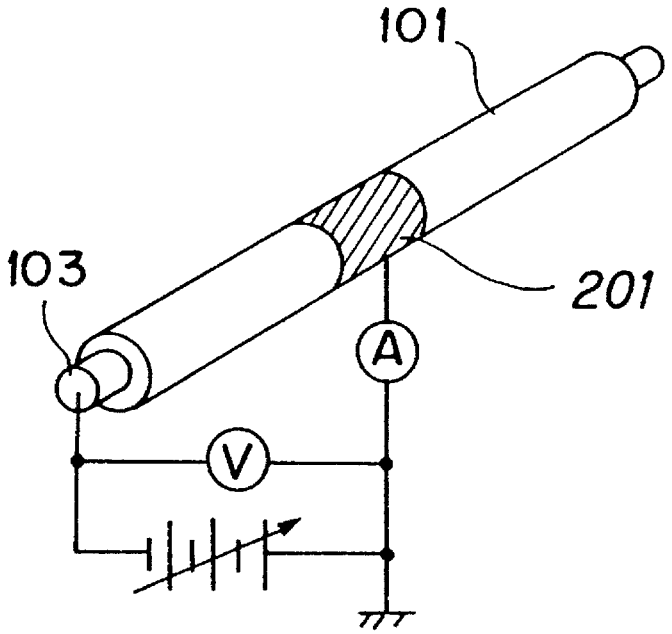
FIG. 2 is an explanatory view showing the V-I characteristics of an roller layer of the electrifying roller as well as a method of measurement of electric resistance of an electrifying roller elastic layer.

FIG. 2 is an explanatory view showing a method of measuring the V-I characteristics of a roller layer 105 of the electrifying roller 101 and an electric resistance of an elastic layer 101*a* of the electrifying roller 101. A tin foil electrode 201 having a width of 18 mm is pasted on a peripheral surface of the electrifying roller 101, a voltage is loaded to between the tin foil electrode 201 and the core metal 103 of the electrifying roller 101, and a current (I) generated when the voltage (V) is loaded is measured.

Then samples of the electrifying roller 101 are prepared. As samples, samples 1 to 3 and samples for comparison 1 and 2 are prepared.

Sample 1

An elastic layer made of epichlorohydrin having an electric resistance of $2\times10^8$ Ω·cm and a thickness of 3 mm is provided on a peripheral surface of core metal with a diameter of 8 mm, and furthermore a surface layer 101*b* made of nylon (CM4000) having a thickness of 5 μm is provided on a peripheral surface of the elastic layer. A diameter of the roller in this case is 14 mm.

Sample 2

An elastic layer made of epichlorohydrin having an electric resistance of $3\times10^8$ Ωcm and a thickness of 4 mm is provided on a peripheral surface of core metal with a diameter of 8 mm, and furthermore a surface layer 101*b* made of hydrin rubber/fluorine resin admixture having a thickness of 7 μm is provided on a peripheral surface of the elastic layer. A diameter of the roller in this case is 16 mm.

Sample 3

An elastic layer made of urethane rubber/alkali metallic salt/carbon-dispersed system having an electric resistance of $3.5\times10^7$ Ωcm and a thickness of 3 mm is provided on a peripheral surface of core metal with a diameter of 6 mm, and furthermore a surface layer 101*b* made of nylon (CM4000) having a thickness of 5 μm is provided on a peripheral surface of the elastic layer. A diameter of the roller in this case is 12 mm.

Then samples for comparison are prepared. It should be noted that an electrifying roller similar to a conventional type of electrifying roller to which both AC and DC voltages are loaded is used as a sample for comparison.

Sample for comparison 1

A surface layer made of cellophane (with an electric resistance of $1\times10^4$ Ωcm) is provided on an elastic layer made of urethane rubber/carbon dispersed system. A diameter of the roller in this case is 16 mm.

Sample for comparison 2

A resistive layer made of hydrin rubber (with an electric resistance in a range from $10^7$ to $10^9$ Ωcm and a thickness thereof of 10 mm) and a surface layer made of nylon/carbon (with an electric resistance in a range from $10^7$ to $10^{10}$ Ωcm and a thickness thereof of 10 mm) are provided on an elastic layer made of EPDM/carbon dispersed system (with an electric resistance in a range from $10^4$ to $10^5$ Ω·cm and a thickness thereof of 3 mm). A diameter of the roller in this case is 16 mm.

Then electrifying rollers incorporating the samples 1, 2, and 3, and also samples for comparison 1 and 2 described above each were prepared as trial rollers 1, 2, 3, 4, and 5 respectively, and the trial rollers 1, 2, 3, 4, and 5 were used in the electrifying roller apparatus shown in FIG. 1, and the electrifying characteristics of the light-sensing body in each case was evaluated.

In the electrifying roller apparatus, it is assumed that a load voltage Va is (−) 1.5 KV, and a linear velocity V of the light-sensing drum 102 is 120 mm/sec.

In the trial rollers 4 and 5, electrified potential Vs was in a range from 800 V to 860 V, but the electrified potential (Vs) was not stable and largely dispersed, and also a leak through pin-holes of the OPC light-sensing drum occurred quite often.

On the contrary, in the trial rollers 1, 2, and 3, electrified potential Vs was in a range from 750 V to 800 V, somewhat lower as compared to that in the trial rollers 4 and 5, but uniformity in electrification thereof was excellent, and a leak of electric charge through pin-holes of the OPC light-sensing drum 102 did not occur.

Figure 3:
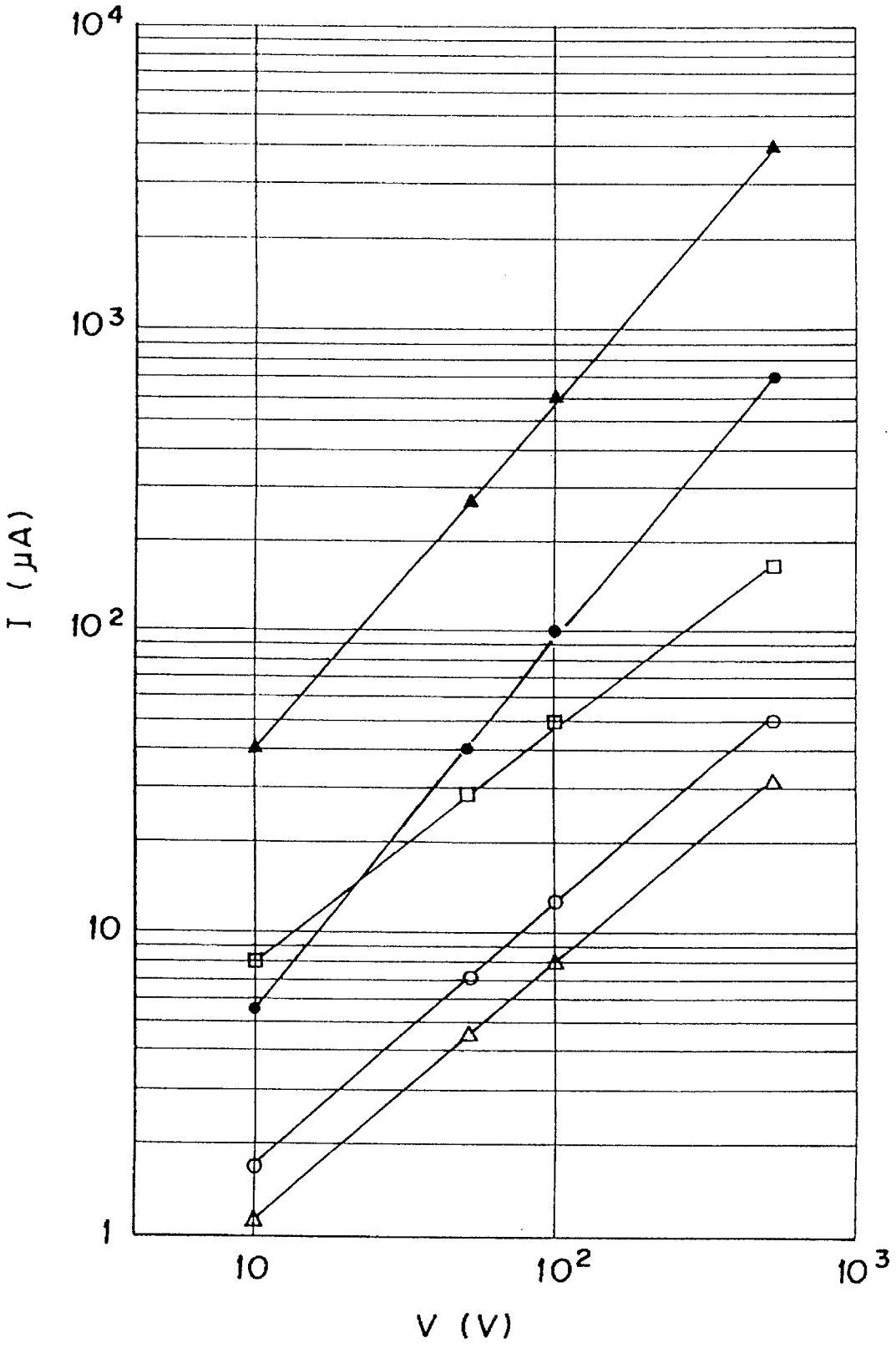
FIG. 3 is a graph showing a current-voltage characteristics of the elastic layer of the electrifying roller.

Then the V-I characteristics of the trial rollers 1 to 5 each was measured by using the method of measuring an electric resistance of the elastic layer of electrifying roller shown in FIG. 2, and the result is shown in FIG. 3. FIG. 3 is a graph showing a current-voltage characteristics of the roller layer of electrifying roller. As shown in FIG. 3, in the trial rollers 1, 2, and 3, an electric resistance of the roller layer is larger as compared to that in the trial rollers 4 and 5, and the dependency on the current (I) flowing through the roller layer on a voltage is small.

It should be noted that straight lines shown in FIG. 3 each indicate the trial rollers respectively as follows;

| | |
|---|---|
| Trial roller 1 | ○ — ○ |
| Trial roller 2 | Δ — Δ |
| Trial roller 3 | □ — □ |
| Trial roller 4 | ● — ● |
| Trial roller 5 | ▲ — ▲ |

Also with reference to FIG. 3, a result of the test for the trial rollers 1, 2, and 3 indicates that a slope (ΔI/ΔV) of the V-I characteristics of the roller layer when expressed on logarithmic paper is 1 or less, namely, if current values are $I_1$ and $I_2$ to given loaded voltage $V_1$ and $V_2$ respectively (it should be noted that, $0<V_1<V_2<2$ KV), a value of $(\log I_2-\log I_1)/(\log V_2-\log V_1)$ is not more than 1.

With Embodiment 1 as described above, by adjusting an electric resistance of the elastic layer of the electrifying roller to a range from $10^7$ to $10^9$ Ωcm, the withstand voltage capability can be improved, namely the uniformity in electrification can be improved, and the possibility of electric charge leak due to pin-holes of the light-sensing drum 102 is eliminated.

As clearly shown in FIG. 3, in the electrifying roller insuring uniformity in electrification, the slope (ΔI/ΔV) of the V-I characteristics of the roller layer when expressed on logarithmic paper is 1 or less. In other words, as shown in Embodiment 1, in an electrifying roller satisfying conditions that electric resistance of the elastic layer of the electric roller is in a range from $10^7$ to $10^9$ Ωcm, and the slope (ΔI/ΔV) of the V-I characteristics of the roller layer in the electrifying roller when expressed by logarithmic paper is 1 or less, uniformity of electrification is improved, and generation of a leak due to pin-holes of the light-sensing drum can be avoided.

[Embodiment 2]

In Embodiment 2, by using the samples 1 to 3 which are electrifying rollers like those in Embodiment 1 and also by using the apparatus shown in FIG. 1, performance of an electrifying roller is checked only by changing the light-sensing drum 102. It is assumed in configuration shown in FIG. 1 that the light-sensing drum 102 is rotated at a linear velocity V of 180 mm/sec.

The following components are used as the light-sensing drum 102.

(1) For electrification with positive polarity: a light-sensing body made of Se system (an overcoat layer made of St-MA denatured urethane resin/$SiO_2$ having a thickness of 3 μm covering $AS_2Se_3$ layer having a thickness of 50 μm)

(2) For electrification with negative polarity: a light-sensing drum of OPC system (a CGL/CTL laminated light-sensing body having a thickness of 25 μm)

Then in Embodiment 2, using the samples 1 to 3 used in Embodiment 1 and the light-sensing drums 102 (1) and (2), electrification was carried out with a load voltage (a DC constant voltage) Va of ±1.65 KV, and the stable electrification having an electrifying potential Vs of (±) 820 V to 900 V could be obtained.

With Embodiment 2 as described above, in the roller electrifying apparatus using the electrifying roller with high withstand voltage capability used in Embodiment 1 and the image forming apparatus using the same, a high DC voltage can be loaded to the core metal of electrifying roller, so that the light-sensing drum 102 can be electrified to a high electric potential, and in addition the electrifying potential can be stabilized.

[Embodiment 3]

Figure 4:
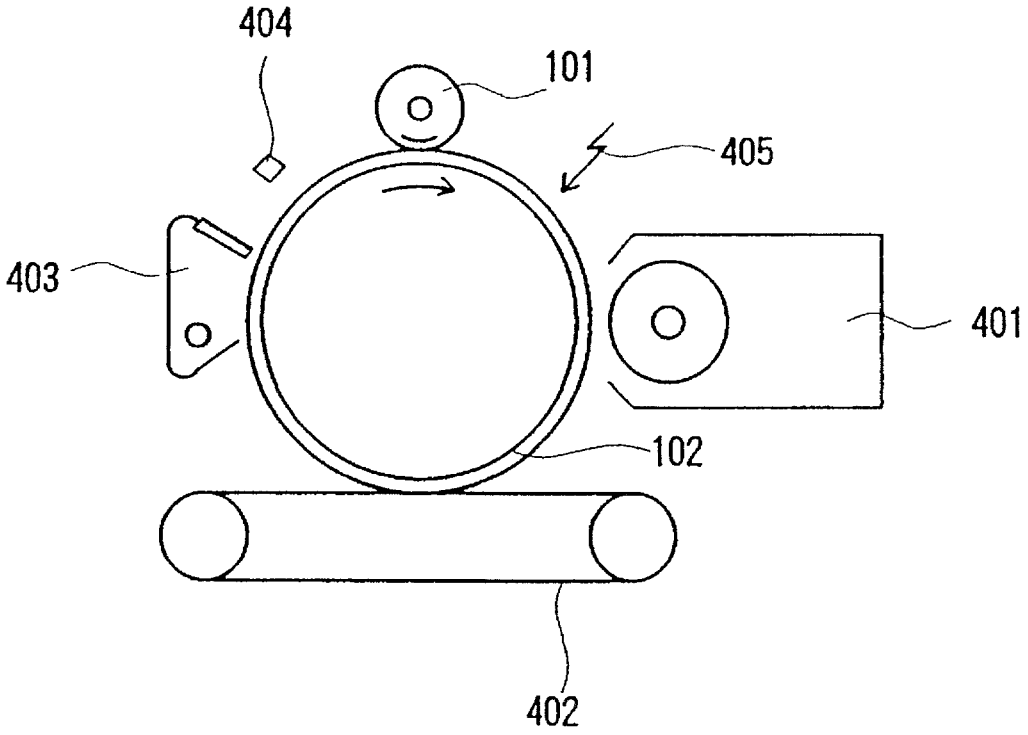
FIG. 4 is a configuration view showing general configuration of an image forming apparatus having the electrifying roller.

Embodiment 3 of the present invention is a case where the electrifying roller according to Embodiment 1 and Embodiment 2 and a roller electrifying roller using the same are applied to an image forming apparatus, and next description is made for Embodiment 3 with reference to FIG. 4. It is assumed in the following description that the samples 1 to 3, which are electrifying rollers like those in Embodiment 1 and the light-sensing drums 102 (1), (2) like those in Embodiment 2 are used.

FIG. 4 is a block diagram illustrating the image forming apparatus according to Embodiment 3. This image forming apparatus comprises an electrifying roller 101 provided on a peripheral surface of the drum-shaped light-sensing drum 102, an image exposure device (not shown herein), a developing device 401, a transfer electrifying belt 402, a cleaning device 403, and a pre-exposure device 404. It should be noted that in this figure, the reference numeral 405 indicates a light for exposure emitted from the image exposure device.

In the image forming apparatus shown in FIG. 4, the samples 1 to 3 are installed in the electrifying roller 101 and the light-sensing drums (1), (2) in the light-sensing drum 102 in various types of combination respectively, and measurement is carried out at a linear velocity V of the light-sensing drum of 210 mm/sec and with a loaded voltage Va of ±1.7 KV.

The measurement method is as shown in FIG. 1. As a result of measurement under the conditions described above, an electrified potential Vs of ±850 to 950 V was obtained. Also in any combination of the samples 1 to 3 and light-sensing drums (1), (2), an image with high density was obtained, and image fault due to nonuniformity in electrification or leak of electric charge did not occur at all.

With Embodiment 3 as described above, the light-sensing drum 102 can be electrified to a high electric potential with a load voltage (Va), so that allowance is generated in bias potential for develop in the image forming apparatus and, eve, if high speed system PCC is used in the image forming apparatus, a high density and high quality image without background contamination.

[Embodiment 4]

Then a sample of the electrifying roller 101 was prepared. As samples, samples 1 to 6 was prepared with those for comparison 1, 2.

Sample 1

An epichlorohydrin elastic layer 101*a* having an electric resistance of $2\times10^8$ Ωcm and a thickness of 2 mm is provided on a peripheral surface of core metal with a diameter of 8 mm, and furthermore a nylon (CM4000) surface layer 101*b* having a thickness of 5 μm is provided on the peripheral surface of the elastic layer 101*a*. A diameter of the roller in this case is 12 mm.

Sample 2

An epichlorohydrin elastic layer 101*a* having an electric resistance of $3\times10^8$ Ωcm and a thickness of 3 mm is provided on a peripheral surface of core metal with a diameter of 8 mm, and furthermore a surface layer 101*b* made of hydrin rubber/fluorine resin admixture (mixing ratio of 1/3.5) and having a thickness of 7 μm is provided a peripheral surface of the elastic layer. A diameter of the roller in this case is 14 mm.

Sample 3

An elastic layer 101*a* made of a material in which urethane, alkali metal salt, and carbon are dispersed and having an electric resistance of $3.5\times10^7$ Ωcm as well as a thickness of 3 mm is provided on a peripheral surface of core metal having a diameter of 6 mm, and furthermore a nylon (CM4000) surface layer 101*b* having a thickness of 5 μm is provided on a peripheral surface of the elastic layer. A diameter of the roller in this case is 12 mm.

Sample 4

An elastic layer 101*a* made of urethane rubber/alkali metal salt and having an electric resistance of $10^9$ Ωcm and a thickness of 3 mm is provided on a peripheral surface of core metal having a diameter of 6 mm, and furthermore a carbon-dispersed nylon (CM8000) surface layer 101*b* having a thickness of 20 μm is provided on a peripheral surface of the elastic layer. A diameter of the roller in this case is 12 mm.

Sample 5

An epichlorohydrin elastic layer 101*a* having an electric resistance of $2\times10^8$ Ωcm and a thickness of 3 mm is provided on a peripheral surface of core metal having a diameter of 8 mm, and furthermore a carbon-dispersed fluorine resin surface layer 101*b* having a thickness of 20 μm is provided on a peripheral surface of the elastic layer. A diameter of the roller in this case is 14 mm.

Sample 6

A epichlorohydrin elastic layer 101*a* having an electric resistance of $1.5\times10^8$ Ωcm and a thickness of 3 mm is provided on a peripheral surface of core metal having a diameter of 8 mm, and furthermore a hydrin rubber/fluorine resin admixture (mixing ratio: 1/1.7) surface layer 101*b* having a thickness of 30 μm is provided on a peripheral surface of the elastic layer. A diameter of the roller in this case is 14 mm.

Then samples for comparison are prepared. It should be noted that the samples for comparison are similar to electrifying rollers based on the conventional technology in which both AC and DC voltages are loaded.

Sample 1 for comparison

An elastic layer (having an electric resistance of $1\times10^4$ Ωcm) made of urethane rubber with carbon dispersed therein and a surface layer made of cellophane are provided. A diameter of the roller in this case is 16 mm.

Sample 2 for comparison

An elastic layer (having an electric resistance in a range from $10^4$ to $10^5$ Ωcm) made of EPDM with carbon dispersed therein, a hydrin resistive layer (having an electric resistance in a range from $10^7$ to $10^9$ Ωcm), and furthermore a nylon/carbon surface layer are provided. A diameter of the diameter in this case is 16 mm.

Then evaluation was made for the electrifying characteristics of the light-sensing drum 102 in a case where the samples above were applied to the roller electrifying apparatus shown in FIG. 1. A voltage Va loaded to the roller electrifying apparatus was (−) 1.5 KV, and a linear velocity V of the light-sensing drum 102 was 120 mm/sec.

In the samples 5,6 and those for comparison 1,2, the electrified potential Vs was in a range from 800 to 900 V, but the electrified potential was not stable with large dispersion, and also leak of electric charge often occurred through pinholes of the OPC light-sensing drum 102.

In contrast, in the samples 1 to 4, the electrified potential Vs was in a range from 750 to 800 V, slightly lower, but uniformity in electrification was high, and leak of electric charge through pin-holes of the OPC light-sensing drum 102 did not occur.

A result of measurement of the V-I characteristics of a roller layer in each sample and a result of evaluation of the electrifying characteristics are shown in Table 1. An electric resistance of the elastic layer 101*a* of the electrifying roller 101 was measured for each sample by using the measuring device shown in FIG. 2.

With the configuration as described above, a linear velocity V of the light-sensing drum 102 was set to 180 mm/sec, and electrification was carried out with a loaded voltage Va of (–) 1.65 KV using the electrifying roller 101 prepared in Embodiment 4 for forming an image, and as a result a high quality image was obtained.

As described above, with Embodiment 5, an image forming apparatus by applying the electrifying roller with excellent withstand voltage capability (Samples 1 to 4 in Embodiment 4) was constructed, so that a voltage loaded to a roller can be increased even at a high operating speed and a high density and high quality image can be obtained.

| Electrifying Roller | Electric Resistance of Elastic Layer of Roller ($\Omega \cdot$ cm) | V-I Characteristics of Roller Layer $V_1 = 10$ V $I_1(\mu A)$ | $V_2 = 100$ V $I_2(\mu A)$ | $\frac{\log I_2 - \log I_1}{\log V_2 - \log V_1}$ | Result of Evaluation of Electrifying Characteristics |
|---|---|---|---|---|---|
| Sample 1 | $2 \times 10^8$ $\Omega \cdot$ cm | 1.7 μA | 13 μA | 0.88 | ○ |
| Sample 2 | $3 \times 10^8$ | 1.4 | 9 | 0.81 | ○ |
| Sample 3 | $3.5 \times 10^7$ | 2.9 | 46 | 1.20 | ○ |
| Sample 4 | $10^9$ | 1.1 | 12 | 1.04 | ○ |
| Sample 5 | $2 \times 10^8$ | 3.5 | 105 | 1.48 | X |
| Sample 6 | $1.5 \times 10^8$ | 1.6 | 26 | 1.21 | X |
| Sample for Comparison | $1 \times 10^4$ | 5.5 | 115 | 1.32 | X |
| Sample for Comparison 2 | $10^{4-5}/10^{7-9}$ | 37 | 610 | 1.22 | X |

As clearly shown in Table 1, in the electrifying rollers with excellent electrifying characteristics, the V-I characteristics of the roller layer satisfies the condition expressed by the expression of $(\log I_2 - \log I_1)/(\log V_2 - \log V_1) \leqq 1.2$ assuming that a current value in the state of $V_1 = 10$ V is $I_1$ μA and a current value is the state of $V_2 = 100$ V is $I_2$ μA. In other words, in an electrifying roller in which an electric resistance of the elastic layer is in a range from $10^7$ to $10^9$ Ωcm and a slope of the V-I characteristics of the roller layer expressed by the equation of $(\log I_2 - \log I_1)/(\log V_2 - \log V_1)$ is 1.2 or less, uniformity in electrification is high, and generation of electric charge leak through pin holes of the light-sensing drum can be suppressed.

As described above, in Embodiment 4, an electric resistance of the elastic layer 101*a* is in a range from $10^7$ to $10^9$ Ωcm, and the V-I characteristics of the roller layer 105 satisfies the condition expressed by the expression of $(\log I_2 - \log I_1)/(\log V_2 - \log V_1) \leqq 1.2$, so that, even if electrification is carried out by loading only a DC voltage to the electrifying roller 101, the withstand voltage capability of the electrifying roller 101 can be improved and leak of electric charge through pin-holes of the light-sensing body can be suppressed.

[Embodiment 5]

FIG. 4 is a block diagram illustrating an image forming apparatus according to Embodiment 5 of the present invention. This image forming apparatus is a system in which the electrifying roller (Samples 1 to 4) according to Embodiment 4 is applied, and as shown in this figure, provided on a peripheral surface of the drum-shaped light-sensing drum 102 are an electrifying roller 101, an image exposure device (not shown), a developing device 401, a transfer belts 402, a cleaning device 403, and a pre-exposure device 404. It should be noted that the reference numeral 405 indicates light for exposure emitted from the image exposure device.

[Embodiment 6]

In the image forming apparatus shown in FIG. 4, an OPC-based light-sensing drum having a diameter of 60 mm was used as a light-sensing drum 102. It is a CGL/CTL laminated light-sensing body with a thickness of 25 μm. The dielectric thickness D ($D = d/\epsilon$) of the light-sensing body is 8.3 (Thickness d: 25 μm, and the specific dielectric constant $\epsilon$: 3). If a layer thickness of the OPC light-sensing body becomes larger, the electrifying efficiency in electrification of the roller becomes slightly lower, but when durability of the OPC light-sensing body is taken into considerations, it is required that D is 8 or more. For this reason, if high electrified potential is required for obtaining a high density image, an electrifying roller with high withstand voltage capability may be used with high voltage to be loaded. Even if any of the samples 1 to 4 in Embodiment 4 is used as the electrifying roller 101, always the stable electrified potential Vs of 850 to 950 V and a high density image could be obtained with the loaded voltage Va of (–) 1.7 KV.

With Embodiment 6, surface potential of an OPC light-sensing body with a dielectric thickness D of 8 or more is electrified to 850 V or more with negative polarity, so that allowance is generated in bias potential for development, and always a high density image without background contamination can be obtained.

It should be noted that the above description assumes an electrifying roller having a roller layer consisting of an elastic layer provided on core metal and a surface layer covering a surface of the elastic layer, but construction in this embodiment is not limited to that described above, and the present invention can be applied to an electrifying roller having a roller layer comprising a single layer or three or more layers.

As described above, with the electrifying roller according to the present invention, in the electrifying roller having a roller layer provided on a peripheral surface of a core metal and comprising at least two layers of an elastic layer and a surface layer covering a surface of the elastic layer, if (an electric resistance of the elastic layer is in a range from $10^7$ to $10^9$ Ωcm, and at the same time) a slope (ΔI/ΔV) of the V-I characteristics of the roller layer when expressed on logarithmic paper is 1 or less, namely, if a current value is $I_1$, $I_2$ to a given loaded voltage $V_1$, $V_2$ respectively (it should be noted that, $0<V_1<V_2<2$ KV), a value of $(\log I_2-\log I_1)/(\log V_2-\log V_1)$ is not more than 1, and for this reason even in a case where the electrifying roller is electrified by loading only a DC voltage thereto, the withstand voltage capability of the electrifying roller can be improved, and at the same time a leak of electric charge due to pin-holes of the light-sensing drum can be avoided.

In the roller electrifying apparatus according to the present invention, (assuming that electric resistance of the elastic layer is in a range from $10^7$ to $10^9$ Ωcm, and) a voltage loaded to a core metal is set to a DC constant voltage of 1.6 KV or more with positive or negative polarity, so that even in a case where an electrifying roller is electrified by loading only a DC voltage thereto, the withstand voltage capability of an electrifying roller can be improved, and at the same time leak of electric charge due to pin-holes of a light-sensing drum can be avoided. Also the light-sensing drum can be electrified to a high electric potential.

In the roller electrifying apparatus according to the present invention, a slope (ΔI/ΔV) of the V-I characteristics of the roller layer of an electrifying roller when expressed on logarithmic paper is set to 1 or less, so that the light-sensing drum can be electrified to a further higher electric potential.

In the image forming apparatus according to the present invention, (at least an electric resistance of the elastic layer of the electrifying roller is in a range from $10^7$ to $10^9$ Ωcm, and), a slope (ΔI/ΔV) of the V-I characteristics of the roller layer of the electrifying roller when expressed on logarithmic paper is 1 or less, so that even in a case where an electrifying roller is electrified by loading only a DC voltage thereto, the withstand voltage capability of an electrifying roller can be improved, and at the same time leak of charge due to pin-holes of the light-sensing drum can be avoided.

In the image forming apparatus according to the present invention, a surface electric potential of the light-sensing drum is electrified to 850 V or more with positive or negative polarity, so that even in a case where an electrifying roller is electrified by loading only a DC voltage, the withstand voltage capability of an electrifying roller can be improved, and at the same time leak of electric charge due to pin-holes of the light-sensing drum can be avoided, and allowance in bias electric potential for development is generated.

The electrifying roller according to the present invention has a roller layer comprising two layers of an elastic layer (with an electric resistance in a range from $10^7$ to $10^9$ Ω·cm) and a surface layer covering a surface of the elastic layer, and assuming that a current value when a DC voltage $V_1$ is 10 V is $I_1$ μA and a current value when a DC voltage $V_2$ is 100 V is $I_2$ μA, the electrifying roller is formed so that the V-I characteristics of the roller layer satisfies the following expression;

$$(\log I_2-\log I_1)/(\log V_2-\log V_1)\leqq 1.2$$

and for this reason, even in a case where the electrifying roller is electrified by loading only a DC voltage, the withstand voltage capability of an electrifying roller can be improved, and at the same time leak of electric charge due to pin-holes of the light-sensing drum can be avoided.

The image forming apparatus according to the present invention has a roller layer comprising two layers of an elastic layer (with an electric resistance in a range from $10^7$ to $10^9$ Ω·cm) and a surface layer covering a surface of the elastic layer, and image forming is executed by using an electrifying roller formed so that the V-I characteristics of the roller layer satisfies the condition expressed by the following expression;

$$(\log I_2-\log I_1)/(\log V_2-\log V_1)\leqq 1.2$$

assuming that a current value when a DC voltage $V_1$ is 10 V is $I_1$ μA and a current value when a DC voltage $V_2$ is 100 V is $I_2$ μA, and for this reason, even in a case where the electrifying roller is electrified by loading only a DC voltage, the withstand voltage capability of an electrifying roller can be improved, and at the same time leak of electric charge due to pin-holes of the light-sensing drum can be avoided.

The image forming apparatus according to the present invention has a roller layer comprising two layers of an elastic layer (of which electric resistance is in a range from $10^7$ to $10^9$ Ω·cm) and a surface layer covering the elastic layer, and image forming is executed using an electrifying roller formed so that the V-I characteristics of the roller layer satisfies the condition expressed by the following equation;

$$(\log I_2-\log I_1)/(\log V_2-\log V_1)\leqq 1.2$$

also by using an organic light-sensing body having a dielectric thickness ($D=d/\epsilon$) of 7.5 or more, and by electrifying a surface electric potential of the light-sensing body to 850 V or more with negative polarity, so that even in a case where an electrifying roller is electrified by loading only a DC voltage, the withstand voltage capability of an electrifying roller can be improved, and at the same time a leak of charge due to a pin-hole of a light-sensing drum can be avoided.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An electrifying roller comprising a metal core and a roller layer provided on a peripheral surface of the metal core, said roller layer comprising at least an elastic layer and a surface layer covering a surface of said elastic layer, wherein a slope (ΔI/ΔV) of the V-I characteristic curve of said roller layer, when expressed on logarithmic paper, is 1 or less.

2. An electrifying roller comprising a metal core and a roller layer provided around the metal core, said roller layer comprising at least an elastic layer and a surface layer covering a surface of said elastic layer, wherein said elastic layer has an electric resistance in a range from $10^7$ to $10^9$ Ω·cm and at the same time a slope (ΔI/ΔV) of the V-I characteristic curve of said roller layer, when expressed on logarithmic paper, is 1 or less.

3. A roller electrifying apparatus having an electrifying roller comprising a metal core, a roller layer on a peripheral surface of the metal core, said roller layer comprising at least an elastic layer and a surface layer covering said elastic layer, and a power supply unit for loading a voltage to the metal core of said electrifying roller, wherein the voltage loaded to said metal core is a DC constant voltage of 1.6 KV or more with positive or negative polarity, wherein in said electrifying roller a slope (ΔI/ΔV) of the V-I characteristic curve of said roller layer, when expressed on logarithmic paper, is 1 or less.

4. A roller electrifying apparatus having an electrifying roller comprising a metal core and a roller layer provided on a peripheral surface of the metal core, said roller layer comprising at least an elastic layer and a surface layer covering said elastic layer, said electrifying roller having an electric resistance in a range from $10^7$ to $10^9$ Ωcm, and a power supply unit for loading a voltage to the metal core of said electrifying roller, wherein the voltage loaded to said metal core is a DC constant voltage of 1.6 KV or more with positive or negative polarity, wherein in said electrifying roller a slope (ΔI/ΔV) of the V-I characteristic curve of said roller layer, when expressed on logarithmic paper, is 1 or less.

5. An image forming apparatus comprising at least a light-sensing drum, a rotary electrifying roller which rotates in contact with said light-sensing drum, an exposure means for projecting light to a surface of the light-sensing drum electrified by said electrifying roller, and a developing means for visualizing a latent image formed by said exposure means, wherein in said electrifying roller comprises a roller layer and has a slope (ΔI/ΔV) of V-I characteristic curve of the roller layer, when expressed on logarithmic paper, is 1 or less.

6. An image forming apparatus according to claim 5, wherein a surface electric potential of said light-sensing drum is electrified to 850 V or more with positive or negative polarity.

7. An image forming apparatus comprising at least a light-sensing drum, a rotary electrifying roller, having a roller layer comprising an elastic layer, which rotates in contact with said light-sensing drum, an exposure means for projecting light to a surface of the light-sensing drum electrified by said electrifying roller, and a developing means for visualizing a latent image formed by said exposure means, wherein an electric resistance of at least the elastic layer of said electrifying roller is in a range from $10^7$ to $10^9$ Ωcm and said electrifying roller has a slope (ΔI/ΔV) of 1 or less when the V-I characteristic curve of the roller layer is expressed on logarithmic paper.

8. An image forming apparatus according to claim 7, wherein a surface electric potential of said light-sensing drum is electrified to 850 V or more with positive or negative polarity.

9. An electrifying roller comprising a metal core and a roller layer provided on a peripheral surface of the metal core, said roller layer comprising at least an elastic layer and a surface layer covering said elastic layer, wherein, assuming that a current value when a DC voltage $V_1$ tied to the electrifying roller is 10 V is $I_1$ μA and a current value when a DC voltage $V_2$ tied to the electrifying roller is 100 V is $I_2$ μA, the V-I characteristics of said roller layer satisfy the following expression;

$$(\log I_2-\log I_1)/(\log V_2-\log V_1)\leqq 1.2.$$

10. An electrifying roller comprising a metal core and a roller layer provided on the metal core, comprising at least an elastic layer and a surface layer covering a surface of said elastic layer, wherein an electric resistance of said elastic layer is in a range from $10^7$ to $10^9$ Ω·cm and, assuming that a current value when a DC voltage $V_1$ tied to the electrifying roller is 10 V is $I_1$ μA and a current value when a DC voltage is $V_2$ tied to the electrifying roller is 100 V is $I_2$ μA, the V-I characteristics of said roller layer is expressed by the following expression;

$$(\log I_2-\log I_1)/(\log V_2-\log V_1)\leqq 1.2.$$

11. An image forming apparatus comprising at least a light-sensing body, an electrifying roller which rotates in contact with said light-sensing body, an exposure means for projecting light to a surface of the light-sensing body electrified by said electrifying roller, and a developing means for visualizing a latent image formed by said exposure means, wherein, assuming that a current value when a DC voltage $V_1$ tied to the electrifying roller is 10 V is $I_1$ μA and a current value when a DC voltage is $V_2$ tied to the electrifying roller is 100 V is $I_2$ μA, the V-I characteristics of said roller layer is expressed by the following expression;

$$(\log I_2-\log I_1)/(\log V_2-\log V_1)\leqq 1.2.$$

12. An image forming apparatus comprising at least a light-sensing body, an electrifying roller, having a roller layer comprising an elastic layer, which rotates in contact with said light-sensing body, an exposure means for projecting light to a surface of the light-sensing body electrified by said electrifying roller, and a developing means for visualizing a latent image formed by said exposure means, wherein the elastic layer of said electrifying roller has an electric resistance in a range from $10^7$ to $10^9$ Ωcm, and, assuming that a current value when a DC voltage $V_1$ tied to the electrifying roller is 10 V is $I_1$ μA and a current value when a DC voltage is $V_2$ tied to the electrifying roller is 100 V is $I_2$ μA, the V-I characteristics of said roller layer is expressed by the following expression;

$$(\log I_2-\log I_1)/(\log V_2-\log V_1)\leqq 1.2.$$

13. An image forming apparatus comprising at least a light-sensitive body, an electrifying roller, having a roller layer, which rotates in contact with said light-sensing body, an exposure means for projecting light to a surface of said light-sensing body electrified by said electrifying roller, and a developing means for visualizing a latent image formed by said exposure means, wherein, assuming that a current value when a DC voltage $V_1$ tied to the electrifying roller is 10 V is $I_1$ μA and a current value when a DC voltage is $V_2$ tied to the electrifying roller is 100 V is $I_2$ μA, the V-I characteristics of the roller layer in said electrifying roller is expressed by the following expression;

$$(\log I_2-\log I_2)/(\log V_2-\log V_1)\leqq 1.2$$

said light-sensing body comprises an organic light-sensing body having a dielectric thickness (D=d/ε) of 7.5 or more, and a surface electric potential of said light-sensing body is electrified to 850 V or more with negative polarity.

14. An image forming apparatus comprising at least a light-sensitive body, an electrifying roller, having a roller layer, which rotates in contact with said light-sensing body, an exposure means for projecting light to a surface of said light-sensing body electrified by said electrifying roller, and a developing means for visualizing a latent image formed by said exposure means, wherein an electric resistance of the elastic layer of said electrifying roller is in a range from $10^7$ to $10^9$ Ωcm, and assuming that a current value when a DC voltage $V_1$ tied to the electrifying roller is 10 V is $I_1$ μA and a current value when a DC voltage is $V_2$ tied to the electrifying roller is 100 V is $I_2$ μA, the V-I characteristics of the roller layer of said electrifying roller is expressed by the following expression;

$$(\log I_2-\log I_2)/(\log V_2-\log V_1)\leqq 1.2,$$

said light-sensing body comprises an organic light-sensing body having a dielectric thickness (D=d/ε) of 7.5 or more, and a surface electric potential of said light-sensing body is electrified to 850 V or more with negative polarity.

* * * * *